United States Patent [19]

Lepage

[11] 4,291,606

[45] Sep. 29, 1981

[54] MUSICAL STRING INSTRUMENT

[76] Inventor: Raymond Lepage, 2580 Sheppard St., Montreal, Canada, H2K 3L2

[21] Appl. No.: 144,079

[22] Filed: Apr. 28, 1980

Related U.S. Application Data

[63] Continuation-in-part of Ser. No. 29,444, Apr. 12, 1979, abandoned.

[51] Int. Cl.[3] ..... G10D 3/00

[52] U.S. Cl. ..... 84/291; 84/314 R

[58] Field of Search ..... 84/267, 268, 284, 291, 84/293, 312 R, 314 R

[56] References Cited

U.S. PATENT DOCUMENTS

| | | | |
|---|---|---|---|
| D. 231,398 | 4/1974 | Pelensky | D17/14 |
| 598,245 | 2/1898 | Gibson | 84/291 |
| 1,751,048 | 3/1930 | Miessner | 84/485 R |
| 2,208,391 | 7/1940 | Rivera | 84/267 |
| 3,521,374 | 7/1970 | Reynolds | 84/267 X |
| 4,031,798 | 6/1977 | Sidner | 84/291 |

FOREIGN PATENT DOCUMENTS

| | | | |
|---|---|---|---|
| 333612 | 3/1921 | Fed. Rep. of Germany | 84/293 |

*Primary Examiner*—Lawrence R. Franklin

[57] ABSTRACT

A new musical eight-string instrument in which the body, or resonance chamber, has an ovoidal lute-like shell and a flat sound board having an oval-shape contour, with a larger arc on the bass string side of the neck and a smaller arc followed by a concave portion on the other side of the neck. The larger side meets with the neck at the twelfth fret, while the smaller side meets the neck at the twentieth fret to allow easy access to the strings at all frets. The neck of instrument is joined to the shell by a spine. This new instrument is also tuned in a new manner, so that its eighth open strings are tuned in seven superimposed intervals of four half-tones, in order to make it much easier for the finger board fingers of the player. A positive note identification means is also disclosed for the finger board of any string musical instrument, consisting of rectangular areas of visually contrasting shades, one shade for the natural notes and another shade for the altered notes.

7 Claims, 39 Drawing Figures

Fig. 5
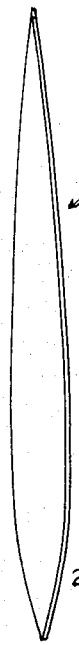
Fig. 6
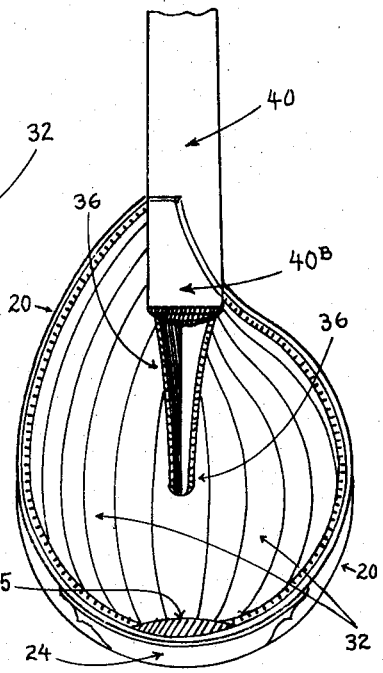
Fig. 7
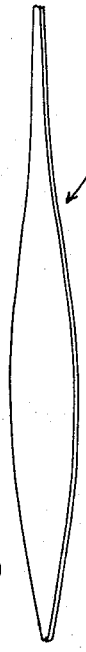
Fig. 8
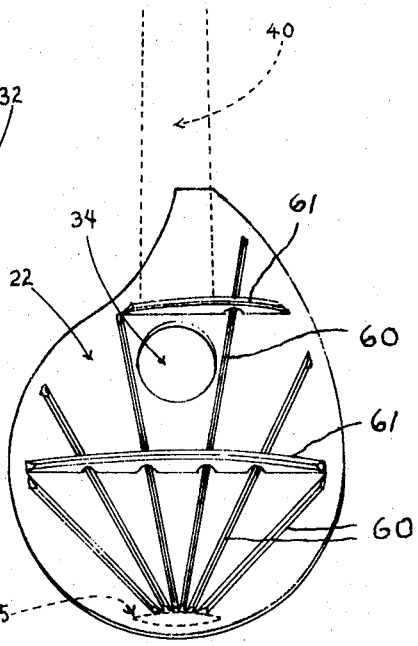
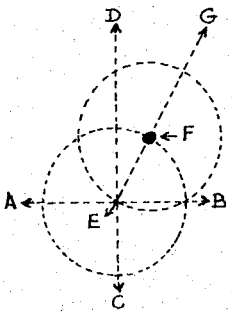
Fig. 9
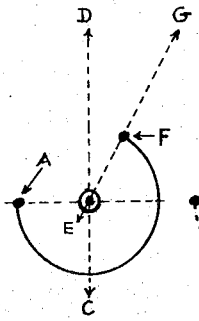
Fig. 9A
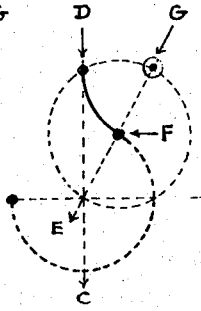
Fig. 9B
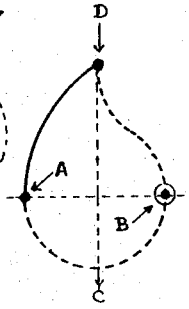
Fig. 9C
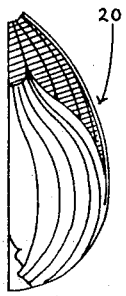
Fig. 10

MUSICAL STRING INSTRUMENT

The following is a continuation-in-part of the application bearing serial number 29,444 and filed Apr. 12, 1979, now abandoned.

FIELD OF THE INVENTION

This invention relates to musical fretted string instruments of the type having a neck and a finger board, more specifically to a string instrument having novel construction and note identification means on the finger board.

BACKGROUND OF THE INVENTION

Fretted instruments have a finger board neck which is pre-divided on its playing surface into equally tempered semi-tones by means of spaced-apart upraised strips commonly called frets. When an instrumentalist plays a melody or chord on such an instrument, the right hand fingers are used to pluck or strum the strings while the fingers of the left hand play the proper notes or chords on the finger board.

It frequently happens that a novice musician (as well as those more advanced in the study of such instruments) experiences some difficulty in locating the proper note for the finger board hand to play. Searching for the right note can be a problem whether scales are being practiced or an actual melody played, resulting in an off-key note or a disruption in the rhythm of the piece of music.

The present invention aids in resolving this problem by introducing, in the manner described below, visual means of note-identification on the finger board to augment and support ear-hand coordination. The means proposed herein are based on the well known fact that eye-hand coordination is very well developed in most individuals.

It is also within the scope of the present invention to provide an entirely new musical string instrument similar to a guitar or lute but having a novel construction and tuned in such a way so as improve the finger board hand technique.

OBJECTS OF THE INVENTION

It is a prime object of the present invention to provide a note-identification means on the finger board of fretted string instruments to aid in the location of notes.

It is another object of the present invention to provide an entirely new instrument having pleasing sound qualities.

It is yet another object of the present invention to provide a different tuning on the new instrument which greatly simplifies finger board hand technique.

SUMMARY OF THE INVENTION

The above objects are realized in accordance with a preferred embodiment of a string instrument having an ovoidal body shell, a fretted finger board and a pegboard. The finger board is provided, adjacent each fret and under each string with rectangles to indicate whether the corresponding note is sharp, flat or nonaltered, much as the black and white notes on the keyboard of a piano. These rectangles may be formed in any suitable manner such that there is a colour differentiation between altered and natural notes.

The instrument itself is made in an entirely new manner: the body shell, or resonance chamber, is made of specially curved strips or ribs secured together by suitable means to form a rounded ovoid shape. The neck of the instrument, which is wide enough to accommodate eight strings, is joined to the resonance chamber by a spine extending from the neck in a downward curve to a position adjacent the bottom of the resonance chamber. The curved ribs differ from the ribs of a lute in that they are of different shapes and lengths.

When seen from the top, the resonance chamber is oval-shaped, having a large arc on the bass string side of the neck and a smaller arc becoming concave on the higher frequency string side of the neck thus allowing a player to reach with ease even the highest frets.

The spine is slightly offset toward the higher frequency string side of the neck where it is joined thereto to allow the thumb of the finger board hand to slide easily to the highest frets.

The sound board is flat and is provided on its underside with a plurality of braces including at least one transverse brace adjacent the sound hole.

The instrument is tuned in intervals of major thirds to achieve greater somatic economy for the fingers of the finger board hand.

The above will be more clearly understood by having referral to the preferred embodiments of the invention illustrated by way of the accompanying drawings in which:

Figure 1:
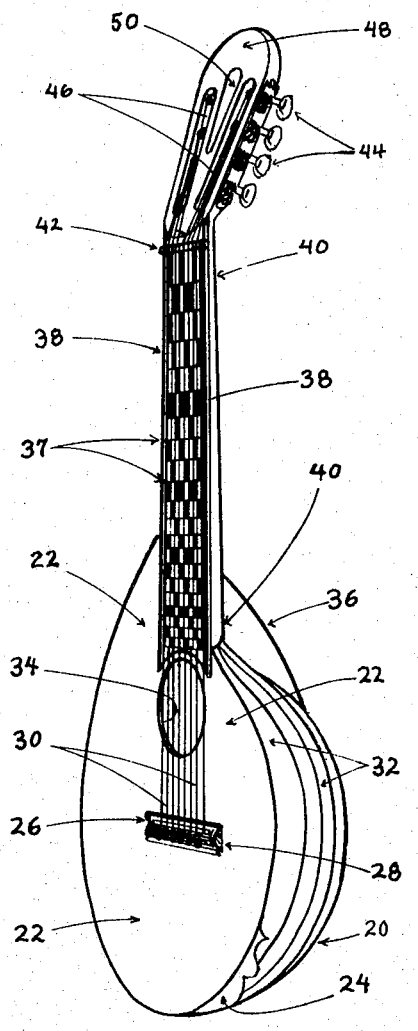
FIG. 1 is a perspective view of the new instrument.
Figure 2:
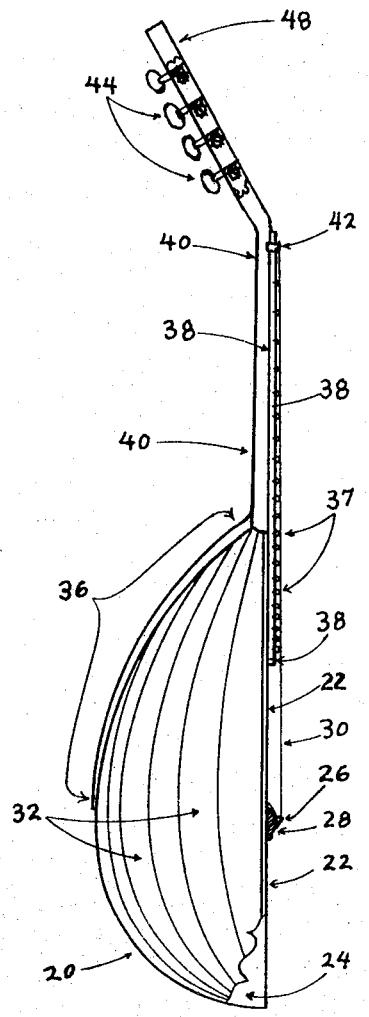
FIG. 2 is an elevation view of the base string side of the instrument.
Figure 3:
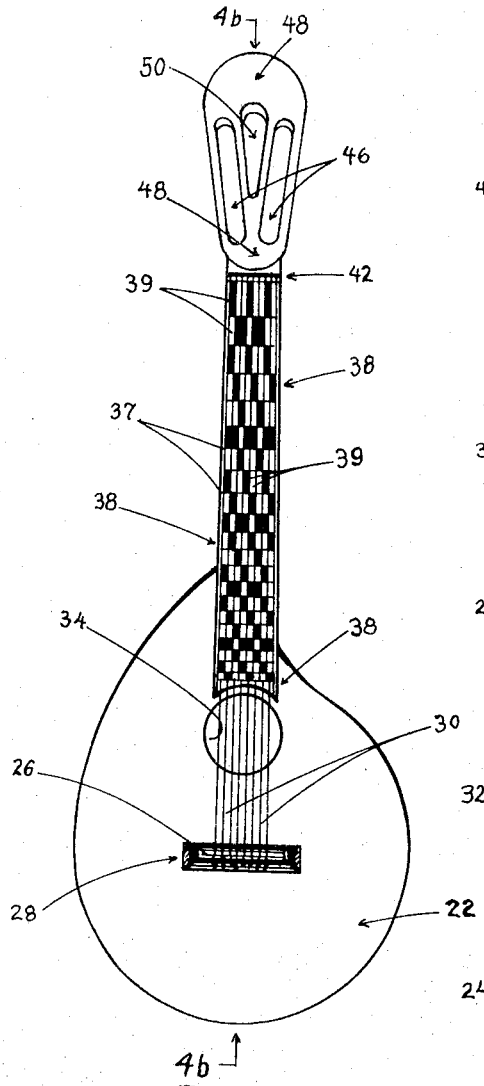
FIG. 3 is a front elevation of the instrument.
Figure 11:
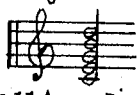
Figures 11A, 11B:
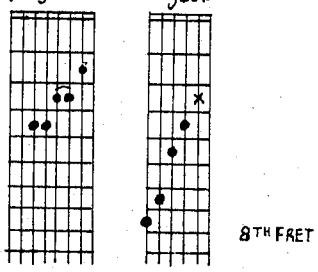
Figure 12:
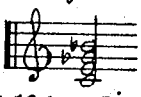
Figures 12A, 12B:
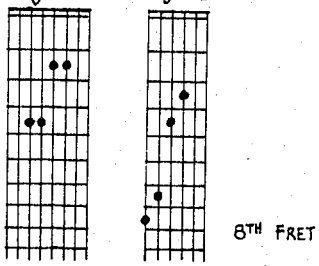
Figure 13:
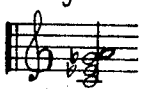
Figures 13A, 13B:
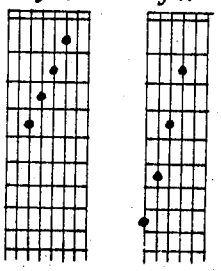

FIG. **4*b* is a longitudinal cross-sectional view taken along line 4B of FIG. 3**;

FIG. 5 is a perspective view of one of the ribs located on the base string side of the instrument;

FIG. 6 is a front elevation of the resonance chamber and a portion of the neck with the sound board removed to show the inside of the resonance chamber and the spine;

FIG. 7 is a perspective view of one of the ribs of the higher frequency string side of the resonance chamber;

FIG. 8 is an elevation view of the underside of the sound board showing the brace structure;

FIGS. **9–9*c*** are schematic views showing the geometry for the shape of the resonance chamber;

FIG. 10 is a side elevation of a completed resonance chamber;

FIG. 11 is a musical staff notation for, as an example, a C major 9th chord;

FIGS. 11A and 11B are schematic representations of a portion of the finger boards of the new instrument of this invention and a guitar, respectively, with the black dots showing the position of the fingers;

FIGS. **12–12*b* and 13–13*b*** are further musical staff notations and schematic representations respectively, comparing the fingering of other chords on the instrument of this invention and a guitar;

FIGS. **14–14*c*** are musical staff notations and schematic representations respectively, showing the finger positions for a C major triad on the guitar, lute and the instrument of this invention.

Figures 15, 15A, 15B:
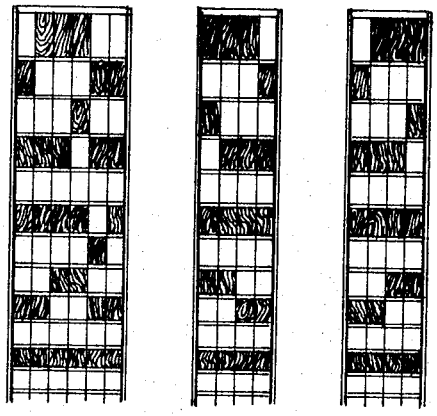
Figure 16:
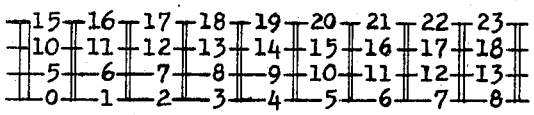
Figure 17:
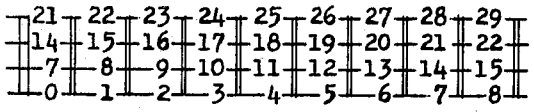
Figure 18:
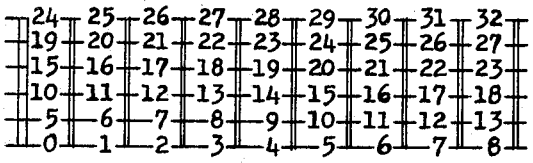
Figure 19:
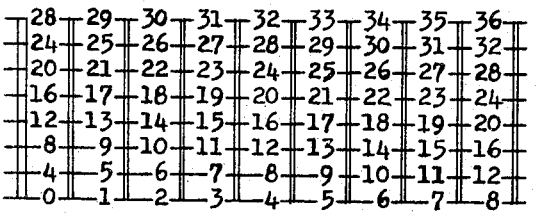
Figure 20:
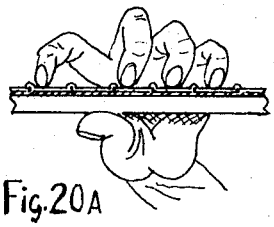
Figure 20A:
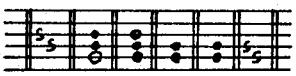
Figure 20B:
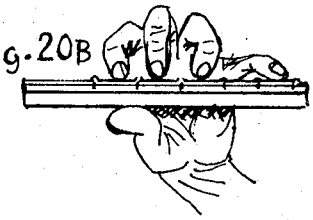
Figure 20C:
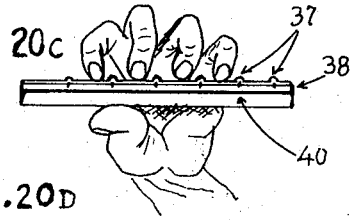
Figure 20D:
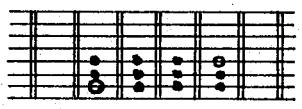

FIGS. 15 to **15*b*** are top plan views of portions of the finger board of a guitar, an instrument tuned in fifths and an instrument tuned in fourths respectively, showing the patterns of the note identification means;

FIGS. 16–19 inclusively are schematic representations of the finger boards of an instrument tuned in fourths, an instrument tuned in fifths, a guitar and the instrument of this invention respectively, wherein the horizontal lines represent the strings, the vertical lines represent the frets and the numbers representing the positions of a chromatic scale with zero indicating the first fret position of the base string;

FIG. 20 is a side elevation of a portion of a finger board also showing a hand in fingering position for a non-isometric tuning;

FIG. 20*a* is a schematic representation of a portion of the finger board of a six-string instrument having non-isometric tuning wherein the solid and circled points indicate finger position;

FIG. 20*b* is a side elevation as in FIG. 20 showing another hand and finger position for non-isometric tuning;

FIG. 20*c* is a schematic representation as in FIGS. 20 and 20*b* showing the position of the fingers at the beginning of a chromatic scale; and FIG. 20*d* is a schematic representation of a portion of the finger board of the instrument of this invention, wherein the dots indicate finger progression of a chromatic scale from string to string.

Like numerals indicate like elements throughout the drawings.

DETAILED DESCRIPTION OF THE INVENTION

The instrument of the present invention is comprised of a resonance chamber or body shell 20 which is formed of a plurality of specially curved ribs 32 as described in the first application of this disclosure, a flat sound board 22, a neck 40 on which is secured a finger board 38, and a peghead 48.

It is to be noted that the construction of shell 20 is similar to that of a lute with the difference that ribs 32 are not alike as clearly shown in FIGS. 5 and 7. The two ribs 32 shown in both figures are as they appear before bending, fitting and trimming operations.

Figure 4:
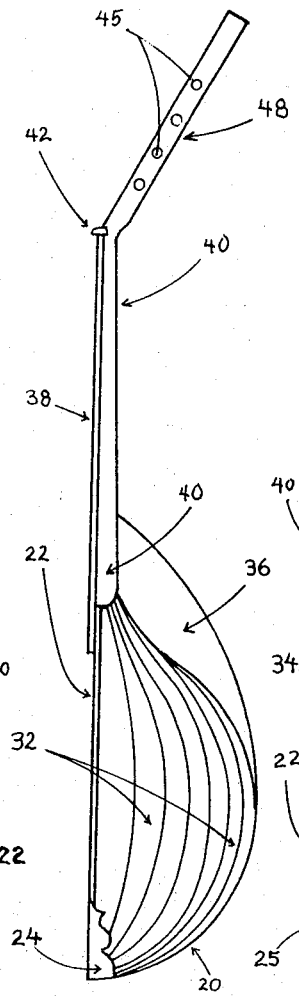
FIG. 4 is an elevation view of the higher frequency string side of the instrument.
Figure 4B:
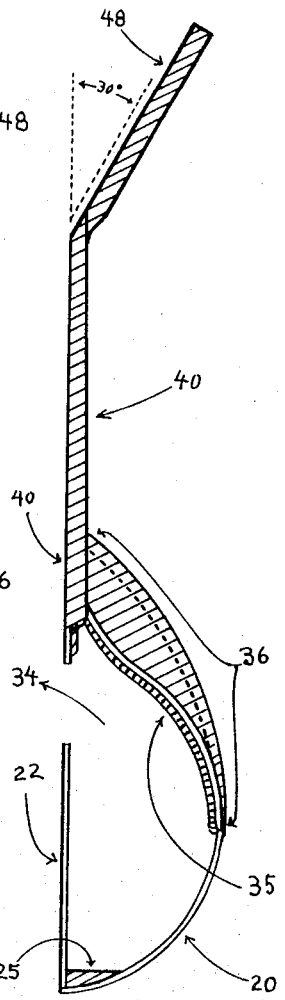

The neck 40 is fitted to the shell 20 by means of a special piece herein called a spine 36, which extends from the shell end of the neck downwardly to a point generally central and at the bottom portion of the shell 20. Spine 36 has a kerf 35 on one side for the securing of ribs 32 thereto and a second kerf on the opposite side as indicated by the dotted line in the hatched portion of spine 36 in FIG. 4*b*. The other end of ribs 32 are secured at the tail end of shell 20 to a tail block 25 which is hidden by a decorative end piece 24 so that the converging rib tips are not seen on the finished instrument. The number of ribs may vary from seven to 36 according to the luthiers traditional allegiances.

As previously stated, the spine 36 is slightly offset toward the bass string side of the neck whereby the thumb of the finger board hand may slide without obstruction to the highest frets. The portion of 40*b* of the neck is recessed to allow a flush fit between neck 40 and sound board 22.

The sound board 22, generally having an oval shaped when seen from the top, is glued to the top of the shell 20. Sound board is strengthened by a plurality of straight braces 60 each having one end secured to the tail block 25 and radiating outwardly therefrom as seen clearly in FIG. 8 in a fan-shaped arrangement. Two transverse braces 61 are also provided, one adjacent the sound hole 34 and a second across the widest portion of the instrument body shell 20.

As seen clearly in FIG. 3, sound board 22 describes a smaller arc becoming concave on the higher frequency string side of neck 40 adjacent the latter, thus allowing the musician to reach the high frets.

The neck 40 is wide enough to accommodate eight strings 30. One end of each string 30 is secured to a bridge 28 and passes over a saddle 26. The other end of each string 30 is secured to a roller located in peghead 48 after passing over nut 42 at the peghead end of the neck. The strings are tensioned and tuned by tuning pegs 44 which operate the rollers in the conventional manner. The rollers are located in slots 46. A decorative slot 50 is included.

A finger board 38 is glued to the upper surface of neck 40 and is provided with transversely spaced-apart frets 37 in the known manner.

Finger board 38 is also provided with positive note identification means. The latter consists of rectangular pieces 39, preferably inlaid, and having visual contrast. For example, all the natural notes may have a corresponding white or pale-colored piece 39 while all the sharp or flat notes would have a corresponding dark or black piece, much as the keys of a piano are divided into black and white. Each piece 39 is located behind and up to the fret of the note to be played and directly underneath each string 30, proceeding up the finger board for every note.

It is to be understood that these rectangular pieces 39 are not limited to the finger board of the present invention, but may be applied to any string instrument having a fretted finger board. Examples of other instruments are shown in FIGS. 15*a* and 15*b*.

FIGS. 9–9*c* are self-explanatory, showing the geometrical steps to be followed in constructing the profile of sound board 22 and of shell 20.

The instrument of the present invention is tuned in an entirely new manner, that is, in the interval of the major third. Thus the preferred tuning of the instrument is C, E, G#, C, E, G#, C, E, although the tuning could begin with any note in the chromatic scale.

FIG. 11 shows a musical staff with a traditional harmony chord (built by superimposed thirds). The advantage of tuning in major third intervals is shown in FIGS. 11*a* and 11*b* wherein the finger positions for the instrument of this invention and guitar, respectively, are compared. Clearly, this chord is impossible to execute on guitar (tuned E, A, D, G, B, E) because it requires a seven inch reach between the index and auricular fingers of the finger board hand.

Similarly, FIGS. 12–14*c* inclusively show the greater naturalness of fingering chords with the instrument of the present invention in contrast to other instruments and other tunings. This ease of fingering is achieved because the major third interval is the only one having four semi-tones, corresponding to the four available fingers of the finger board hand. Another advantage is that endless accumulations of variable and/or scale patterns are eliminated: it is well known that non-isometric tunings of string instruments lead to a proliferation of such accumulations.

Figure 14:
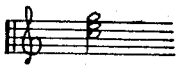
Figures 14A, 14B, 14C:
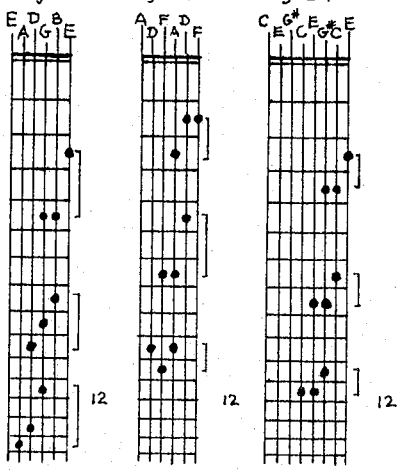

For example, FIGS. 14*a* to 14*c* show finger positions for a C major triad for guitar, lute and the instrument of the present invention respectively. It is readily apparent that the chord pattern for both lute and guitar changes as the hand moves up the finger board, while the pattern for the instrument of this invention remains the same, regardless of where on the finger board and on which group of strings it is fingered.

FIGS. 16 to 20*d* inclusively are meant to further illustrate the advantages of the new tuning as compared to other tunings.

What I claim is:

1. A musical string instrument comprising a body shell of generally ovoid shape and formed of a plurality of ribs of varying shapes depending on which side of said shell they are located; a flat sound board of generally oval shape secured to the top of said shell and provided with a sound hole; a tail block secured to the remote end of said shell, the corresponding ends of all said ribs being secured to said tail block; a plurality of braces secured to the underside of said sound board and radiating from said tail block; at least one transverse brace secured across the widest portion of said shell; further comprising a neck wide enough to accommodate eight strings, a fretted finger board secured to the top surface of said neck, said finger board being provided with positive note identification means; a peghead secured to said neck; two slots being provided in said peghead, each said slot having rollers for four strings; tuning pegs to operate said rollers in a known manner; a spine securing said neck to said body shell wherein said spine extends from said neck downwardly and curvedly to the central bottom portion of said body shell; said sound board being further provided with a bridge having a saddle for said strings.

2. A musical string instrument as defined in claim 1, wherein said positive note identification means consists of rectangular pieces having visual contrast secured to said finger board and located behind and up to each fret and directly underneath each string, wherein the natural notes of the chromatic scale are provided with one shade and the other altered notes are provided with a visually contrasting shade.

3. A musical string instrument as defined in claim 1, wherein said body shell and said sound board describe a large arc on the base string side of the instrument and a smaller arc becoming concave on the opposite side of the instrument adjacent said neck, whereby the highest frets may be easily reached by the finger board hand.

4. A musical string instrument as defined in claim 3, wherein said spine is slightly offset on said neck adjacent said body shell toward the base string side of the instrument whereby the thumb of the finger board hand may reach the highest position easily.

5. A musical string instrument as defined in claim 4, wherein a second transverse brace is provided adjacent said sound hole.

6. A musical string instrument as defined in claim 5, wherein said sound hole is reinforced by a thin laminated wooden ring having two layers, one of the layers having the grain oriented in the same direction as the grain of said sound board.

7. A musical string instrument as defined in claim 1, wherein said strings are tuned in consecutive intervals of major thirds.

* * * * *